US010319280B2

(12) United States Patent
Kim et al.

(10) Patent No.: US 10,319,280 B2
(45) Date of Patent: Jun. 11, 2019

(54) DISPLAY DEVICE AND DRIVING METHOD THEREOF

(71) Applicant: SAMSUNG DISPLAY CO., LTD., Yongin-si, Gyeonggi-do (KR)

(72) Inventors: Il Nam Kim, Yongin-si (KR); Won Sang Park, Yongin-si (KR); Gee Bum Kim, Yongin-si (KR); Ki Seo Kim, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 516 days.

(21) Appl. No.: 14/994,041

(22) Filed: Jan. 12, 2016

(65) Prior Publication Data

US 2016/0365018 A1 Dec. 15, 2016

(30) Foreign Application Priority Data

Jun. 10, 2015 (KR) ..... 10-2015-0082083

(51) Int. Cl.

| | |
|---|---|
| ***G09G 5/10*** | (2006.01) |
| ***G09G 3/20*** | (2006.01) |
| ***G09G 5/04*** | (2006.01) |

(52) U.S. Cl.

CPC ..... *G09G 3/2092* (2013.01); *G09G 5/04* (2013.01); *G09G 2320/0242* (2013.01); *G09G 2320/0666* (2013.01); *G09G 2360/16* (2013.01)

(58) Field of Classification Search

CPC ..... G09G 3/2092; G09G 5/04; G09G 2320/0242; G09G 2320/0666

(Continued)

(56) References Cited

U.S. PATENT DOCUMENTS

| | | |
|---|---|---|
| 7,333,117 B2 | 2/2008 | Kim |
| 8,345,338 B2 | 1/2013 | Jeong et al. |

(Continued)

FOREIGN PATENT DOCUMENTS

| | | |
|---|---|---|
| KR | 10-2005-0011115 A | 1/2005 |
| KR | 10-2005-0044114 A | 5/2005 |

(Continued)

OTHER PUBLICATIONS

Shin, Y.J. et al., Abstract for "Efficacy of the Computer Program to Compensate Color Vision Deficiency using Seohan Computerized 85-Hue Test", Journal of the Korean Ophthalmological Society, 2006, 1 Page, vol. 47, No. 10, The Korean Ophthalmological Society, Korea.

(Continued)

*Primary Examiner* — Jonathan M Blancha
(74) *Attorney, Agent, or Firm* — Lewis Roca Rothgerber Christie LLP

(57) ABSTRACT

There is provided a display device including a display panel including pixels, and a display panel driver configured to drive the display panel, wherein the display panel driver includes a timing controller configured to receive image signals and timing signals from the outside, to convert at least some of the image signals, and to output the converted image signals, wherein the image signals include first image signals corresponding to a first area in the display panel, wherein each of image signals corresponds to each of the pixels and includes a red signal, a green signal, and a blue signal, wherein the timing controller includes a signal receiver configured to receive the image signals and the timing signals, and a first converter configured to receive the first image signals from the signal receiver, to perform color weakness-compensating conversion on the first image signals, and to output the converted first image signals.

14 Claims, 7 Drawing Sheets

(58) Field of Classification Search
USPC ..... 345/691
See application file for complete search history.

(56) References Cited

U.S. PATENT DOCUMENTS

| | | | | |
|---|---|---|---|---|
| 2006/0176311 | A1* | 8/2006 | Kimoto | H04N 9/3182 345/589 |
| 2006/0203102 | A1 | 9/2006 | Yang et al. | |
| 2006/0256127 | A1 | 11/2006 | Cho et al. | |
| 2007/0236656 | A1* | 10/2007 | Jeong | H04N 9/68 351/159.24 |
| 2008/0225055 | A1* | 9/2008 | Yu | G09G 3/2003 345/600 |
| 2010/0322536 | A1* | 12/2010 | Tezuka | G06T 3/00 382/300 |
| 2011/0292087 | A1* | 12/2011 | Lim | G09G 3/3225 345/690 |
| 2012/0147163 | A1* | 6/2012 | Kaminsky | G09G 5/028 348/62 |
| 2013/0135632 | A1* | 5/2013 | Yamada | G06K 15/1882 358/1.9 |
| 2013/0241970 | A1 | 9/2013 | Lee et al. | |
| 2013/0311941 | A1* | 11/2013 | Fields | G06F 3/04883 715/800 |
| 2014/0015850 | A1 | 1/2014 | Ahn et al. | |
| 2015/0091826 | A1* | 4/2015 | Oh | G06F 3/044 345/173 |

FOREIGN PATENT DOCUMENTS

| | | | |
|---|---|---|---|
| KR | 10-2006-0116511 | A | 11/2006 |
| KR | 10-2007-0099969 | A | 10/2007 |
| KR | 10-2013-0030667 | A | 3/2013 |
| KR | 10-2013-0105057 | A | 9/2013 |
| KR | 10-2014-0008977 | A | 1/2014 |
| KR | 10-2014-0100200 | A | 8/2014 |

OTHER PUBLICATIONS

Yang, S. et al., Improving Visual Accessibility for Color Vision Deficiency Based on MPEG-21, ETRI Journal, Jun. 2004, pp. 195-202, vol. 26, No. 3, ETRI, Korea.

* cited by examiner

DISPLAY DEVICE AND DRIVING METHOD THEREOF

CROSS-REFERENCE TO RELATED APPLICATION

This application claims priority to and the benefit of Korean Patent Application No. 10-2015-0082083, filed in the Korean Intellectual Property Office, on Jun. 10, 2015, the entire content of which is incorporated herein by reference.

BACKGROUND

1. Field of the Disclosure

The present disclosure relates to a display device and a driving method thereof.

2. Description of the Related Art

Various kinds of display devices that are capable of reducing detriments of cathode ray tubes, such as their heavy weight and large size, have been developed in recent years. The display devices include a liquid crystal display device, a field emission display device, a plasma display panel device, and an organic light emitting display device. The display devices have been more commonly and widely used. In particular, they are being used in transportation vehicles, such as cars, trucks, or the like, as well as in unmoving spaces, for example, houses, theaters, or the like.

Recently, research for expanding a utility of the display as well as improving performance of the display has been actively conducted.

SUMMARY

Aspects of embodiments of the present disclosure are directed toward a display device in which a first area of a display panel for displaying an image after color weakness-compensating conversion is performed and a second area of the display panel for displaying an image without the color weakness-compensating conversion are included, and a driving method thereof.

In addition, aspects of embodiments of the present disclosure are directed toward a display device capable of implementing an image display for persons with color vision impairment and an image display for normally sighted persons at the same time, and a driving method thereof.

According to an exemplary embodiment of the present disclosure, there is provided a display device including: a display panel including pixels; and a display panel driver configured to drive the display panel, wherein the display panel driver includes a timing controller configured to receive image signals and timing signals from the outside, to convert at least some of the image signals, and to output the converted image signals, each of the image signals corresponding to a respective one of the pixels, wherein the image signals include first image signals corresponding to a first area in the display panel, wherein each of image signals corresponds to each of the pixels and includes a red signal, a green signal, and a blue signal, wherein the timing controller includes a signal receiver configured to receive the image signals and the timing signals, and a first converter configured to receive the first image signals from the signal receiver, to perform color weakness-compensating conversion on the first image signals, and to output the converted first image signals.

In an embodiment, the red signal, the green signal, and the blue signal of one of the first image signals change to a converted red signal, a converted green signal, and a converted blue signal of one of the converted first image signals according to the following equation:

$$\begin{bmatrix} RCt \\ GCt \\ BCt \end{bmatrix} = \frac{X}{255}[\Gamma^{-1}]\begin{bmatrix} RC \\ GC \\ BC \end{bmatrix}$$

where RC, GC and BC refer to the red signal, the green signal, and the blue signal, respectively, of one of the first image signals, RCt, GCt and BCt refer to the converted red signal, the converted green signal, and the converted blue signal, respectively, of one of the converted first image signals, X refers to a gray-compensating value, and $\Gamma^{-1}$ refers to an inverse matrix of a daltonization matrix.

In an embodiment, the image signals further include second image signals corresponding to a second area not overlapping with the first area in the display panel, wherein the timing controller further includes a second converter configured to receive the second image signals, to perform size conversion on the second image signals to generate converted second image signals, and to output the converted second image signals.

In an embodiment, the red signal, the green signal, and the blue signal of one of the second image signals change to a converted red signal, a converted green signal, and a converted blue signal of one of the converted second image signals according to the following equation:

$$\begin{bmatrix} RNt \\ GNt \\ BNt \end{bmatrix} = \frac{X}{255}\begin{bmatrix} RN \\ GN \\ BN \end{bmatrix}$$

where RN, GN and BN refer to the red signal, the green signal, and the blue signal, respectively, of one of the second image signals, RNt, GNt and BNt refer to the converted red signal, the converted green signal, and the converted blue signal, respectively, of one of the converted second image signals, and X refers to a gray-compensating value.

In an embodiment, the signal receiver is further configured to receive selection signals, each of the selection signals correspond to a respective one of the pixels, and the selection signals corresponding to the first area have a first logic value.

In an embodiment, the image signals further include the second image signals corresponding to a second area not overlapping with the first area in the display panel, the timing controller further includes a second converter configured to receive second image signals and to output converted second image signals, and the selection signals corresponding to the second area have a second logic value.

In an embodiment, the timing controller further includes a selection signal generator configured to generate the selection signals, and to receiving coordinate information including a first direction start coordinate, a first direction end coordinate, a second direction start coordinate, and a second direction end coordinate, and each of which corresponds to a respective one of the pixels.

In an embodiment, the selection signals corresponding to ones of the pixels having first direction coordinates between the first direction start coordinate and the first direction end coordinate and having second direction coordinates between the second direction start coordinate and the second direction end coordinate have a first logic value, and the selection signals corresponding to other ones of the pixels having first direction coordinates beyond a range of the first direction start coordinate to the first direction end coordinate or having second direction coordinates beyond a range of second direction start coordinate to the second direction end coordinate have a second logic value.

In an embodiment, the signal receiver is configured to receive the selection signals, to output only ones of the image signals corresponding to the selection signals with the first logic value to the first converter, and not to output other ones of the image signals corresponding to the selection signals with the second logic value.

According to an exemplary embodiment of the present disclosure, there is provided a driving method of a display device, the driving method including: receiving an image signal including a red signal, a green signal, and a blue signal and corresponding to one of pixels; receiving a selection signal; and performing color weakness-compensating conversion on the image signal, wherein the color weakness-compensating conversion is performed only when the selection signal has a first logic value.

In an embodiment, the performing color weakness-compensating conversion includes converting the image signal according to the following equation:

$$\begin{bmatrix} Ro \\ Go \\ Bo \end{bmatrix} = \frac{X}{255}[\Gamma^{-1}]\begin{bmatrix} Ri \\ Gi \\ Bi \end{bmatrix}$$

where Ri, Gi and Bi refer to the red signal, the green signal, and the blue signal, respectively, Ro, Go and Bo refer to a converted red signal, a converted green signal, and a converted blue signal, respectively, after the color weakness-compensating conversion, X refers to a gray-compensating value, and $\Gamma^{-1}$ refers to an inverse matrix of a daltonization matrix.

In an embodiment, the driving method further includes converting a size of the image signal, wherein the converting of the size of the image signal is performed only when the selection signal has a second logic value different with the first logic value.

In an embodiment, the converting of the size of the image signal generates a size-converted image signal according to the following equation:

$$\begin{bmatrix} Ro \\ Go \\ Bo \end{bmatrix} = \frac{X}{255}\begin{bmatrix} Ri \\ Gi \\ Bi \end{bmatrix}$$

where Ri, Gi and Bi refer to the red signal, the green signal, and the blue signal, respectively, Ro, Go and Bo refer to a size-converted red signal, a size-converted green signal, and a size-converted blue signal, respectively, and X refers to a gray-compensating value.

In an embodiment, the driving method further includes generating the selection signal, wherein the generating of the selection signal is performed prior to the receiving of the selection signal.

In an embodiment, the generating of the selection signal includes: extracting a first coordinate and a second coordinate of the pixel corresponding to the image signal; receiving information about a first direction start coordinate, a first direction end coordinate, a second direction start coordinate, and a second direction end coordinate; and generating the selection signal with the first logic value, wherein the generating of the selection signal with the first logic value is performed only when the first coordinate of the pixel corresponding to the image signal is between the first direction start coordinate and the first direction end coordinate and the second coordinate of the pixel corresponding to the image signal is between the second direction start coordinate and the second direction end coordinate.

BRIEF DESCRIPTION OF THE DRAWINGS

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete and will fully convey the scope of the example embodiments to those skilled in the art.

In the figures, dimensions may be exaggerated for clarity of illustration. Like reference numerals refer to like elements throughout.

DETAILED DESCRIPTION

Figure 1:
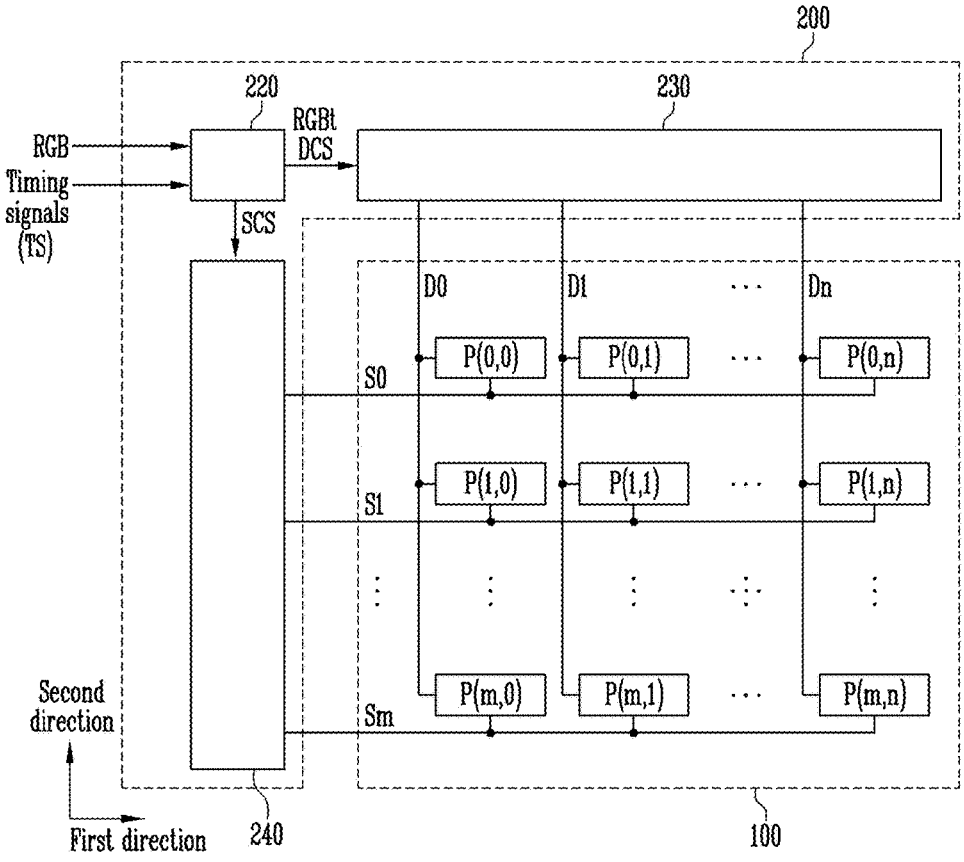
FIG. 1 is a block diagram illustrating a display device according to an exemplary embodiment of the present disclosure.

Hereinafter, exemplary embodiments of the present disclosure will now be described in more detail with reference to the accompanying drawings. In the exemplary embodiments, for components having the same configuration, like reference numerals are used and described only in a representative embodiment. In describing the present disclosure invention, a description of known functions or configurations may not be provided so as to make the subject matter of the present disclosure more clear. The terminology used herein is defined in consideration of the function of corresponding components used in the present disclosure and may be varied according to users.

FIG. 1 is a block diagram illustrating a display device according to an exemplary embodiment of the present disclosure.

Referring to FIG. 1, the display device according to the exemplary embodiment of the present disclosure includes a display panel 100 and a display panel driver 200.

The display panel 100 includes pixels P(0, 0) to P(m, n) (where m and n are positive integers), data lines D0 to Dn for transmitting data signals to the pixels P(0, 0) to P(m, n), and scan lines S0 to Sn for transmitting scan signals to the pixels P(0, 0) to P(m, n). Hereinafter, P(0, 0) to P(m, n), D0 to Dn, S0 to Sn will be referred to as "P", "D", and "S", respectively. The number of the pixels P arranged in a first direction is n+1, and the number of the pixels P arranged in a second direction is m+1. For example, when n is 1919 and m is 1023, the display panel 100 may implement a resolution of 1024×1920. The scan lines S extend in a first direction and the data lines D extend in a second direction crossing the first direction. This structure is only for exemplary purposes, so various suitable variations may be possible.

The display panel driver 200 drives the display panel 100 by generating and supplying the data signals and the scan signals to the data lines D and the scan lines S, respectively. The display panel driver 200 includes a timing controller 220, a data driver 230, and a scan driver 240. The timing controller 220, the data driver 230, and the scan driver 240 may be implemented as independent electronic devices. In some examples, the entire components of the display panel driver 200 may be implemented as one electronic device (e.g., a display driving IC).

The timing controller 220 receives image signals RGB. In addition, the timing controller 220 receives timing signals TS and generates timing control signals for controlling operation timings of the data driver 230 and the scan driver 240. One of the image signals RGB corresponds to one of the pixels P. The timing signals TS will be described later in more detail with reference to FIG. 2. One of dot clocks DOTCLK corresponds to one of the pixels P. The timing control signals include a scan timing control signal SCS for controlling the operation timing of the scan driver 240, and a data timing control signal DCS for controlling the operation timing of the data driver 230 and the data signals. The data timing control signal DCS controls a data sampling start timing of the data driver 230. In addition, the timing controller 220 converts the image signals RGB for color weakness compensation and supplies the converted image signals RGBt to the data driver 230. The below description with reference to FIG. 1 to FIG. 5 is given on the assumption that the color weakness compensation is performed for ease of description. A further detailed description of the timing controller 220 will be given later with reference to FIG. 2 and FIG. 3.

The data driver 230 latches the converted image signals RGBt supplied from the timing controller 220 in response to the data timing control signal DCS. The data driver 230 includes a plurality of source drive integrated circuits (ICs). The source drive ICs may be electrically connected to the data lines D of the display panel 100 by a chip on glass (COG) process or a tape automated bonding (TAB) process.

The scan driver 240 sequentially supplies the scan signals to the scan lines S in response to the scan timing control signal SCS. The scan driver 240 may be directly formed on a substrate of the display panel 100 by a gate in panel (GIP) process, or it may be electrically connected to the scan lines S of the display panel 100 by the TAB process.

Figure 2:
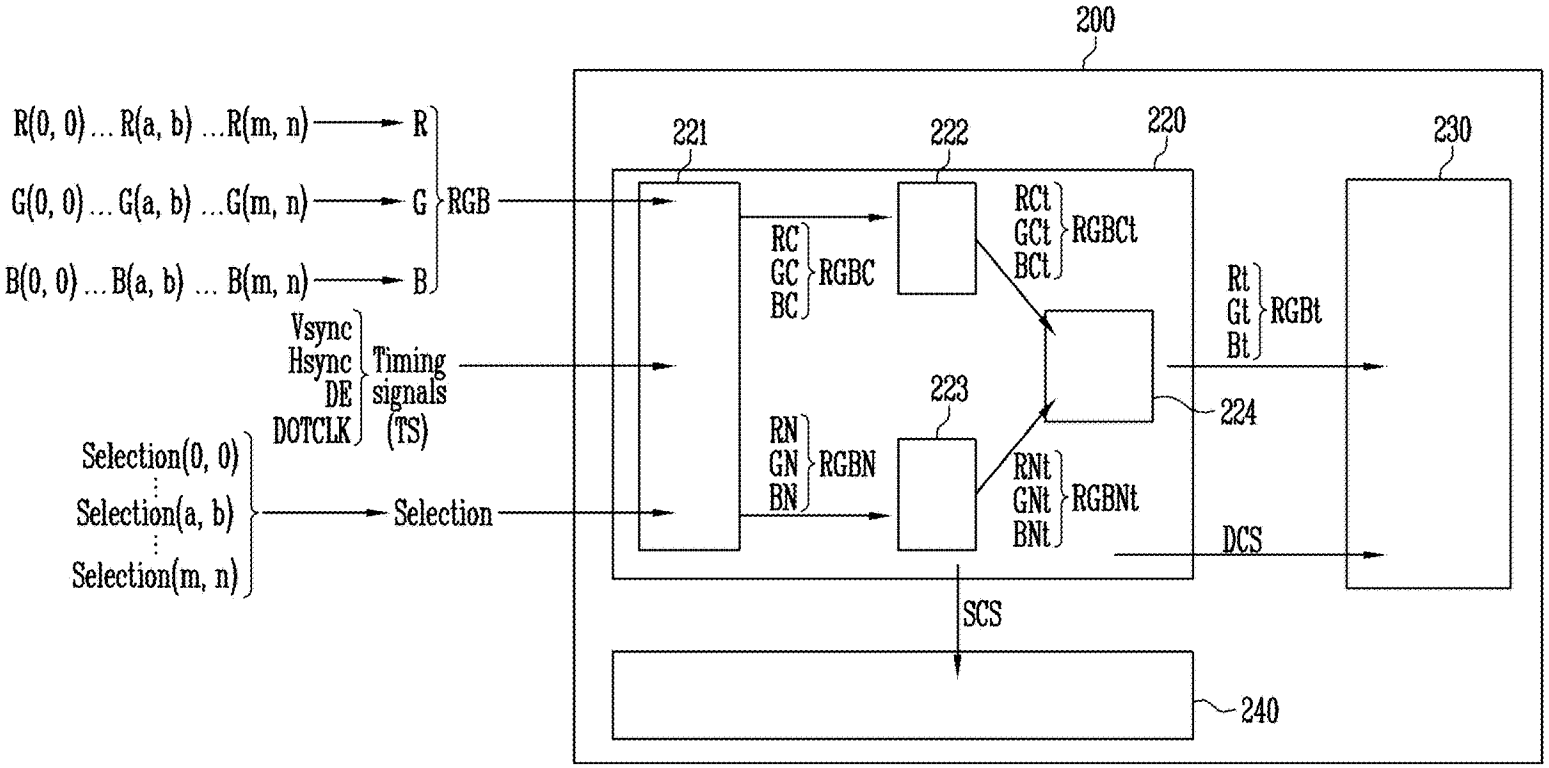
FIG. 2 is a block diagram illustrating an exemplary embodiment of a timing controller in the display device of FIG. 1.

FIG. 2 is a block diagram illustrating an exemplary embodiment of the timing controller in the display device of FIG. 1. Referring to FIG. 2, the timing controller 220 includes a signal receiver 221, a first converter 222, a second converter 223, and a signal transmitter 224.

The signal receiver 221 receives image signals RGB, timing signals TS, and selection signals Selection from the outside (e.g., a control box). The timing signals TS include vertical synchronization signals Vsync, horizontal synchronization signals Hsync, data enable signals DE, and dot clocks DOTCLK. It is determined whether or not the image signals RGB are supplied to the display panel driver 200 or not on the basis of levels of the data enable signals DE. One of the selection signals Selection corresponds to one of the dot clocks DOTCLK and one of the pixels P. For ease of description, the below description will be given based on the image signals RGB and the selection signals Selection supplied for one frame. The image signal RGB(a, b) (where 0≤a≤m, 0≤b≤n, and indices a and b are integers) corresponds to the pixel P(a, b), and the selection signal Selection(a, b) corresponds to the pixel P(a, b). The image signal RGB(a, b) includes a red signal R(a, b), a green signal G(a, b), and a blue signal B(a, b). That is, the image signals RGB include red signals R, green signals G, and blue signals B. Some of the selection signals Selection with a first logic value correspond to a first area of the display panel 100, the others with a second logic value correspond to a second area not overlapping with the first area. The first logic value may be a low level (e.g., a low voltage), whereas the second logic value may be a high level (e.g., a high level). The first area of the display panel 100 may be an area where color weakness-compensating conversion is desired, whereas the second area may be an area where it is undesired (e.g., unnecessary). First image signals RGBC corresponding to the selection signals Selection with the first logic value are supplied to the first converter 222 from the signal receiver 221. Second image signals RGBN corresponding to the selection signals Selection with the second logic value are supplied to the second converter 223 from the signal receiver 221. The first image signals RGBC include first red signals RC, first green signals GC, and first blue signals BC, and the second image signals RGBN include second red signals RN, second green signals GN, and second blue signals BN, respectively. The second converter 223 may be omitted. In this case, the second image signals RGBN are directly supplied to the signal transmitter 224.

The first converter 222 converts the first image signals RGBC to RGBCt. Converted first image signals RGBCt include converted first red signals RCt, converted first green signals GCt, and converted first blue signals BCt.

A person with color vision impairment distortedly perceives red, green, and blue. An algorithm used when such a person distortedly perceives red, green, and blue is called "daltonization algorithm" and the daltonization algorithm represented in a matrix form is called "daltonization matrix".

$$\begin{bmatrix} Rs \\ Gs \\ Bs \end{bmatrix} = [\Gamma]\begin{bmatrix} R \\ G \\ B \end{bmatrix} = \begin{bmatrix} rr & rg & rb \\ gr & gg & gb \\ br & bg & bb \end{bmatrix}\begin{bmatrix} R \\ G \\ B \end{bmatrix} \quad \text{Equation 1}$$

Herein, R, G and B refer to the amount of red, green and blue perceived by a normally sighted person, Rs, Gs and Bs refer to the amount of red, green and blue perceived by a person with color vision impairment, and r refers to a daltonization matrix.

In the daltonization matrix r, the respective components rr, rg, rb, gr, gg, gb, br, bg, and bb have different values depending on the kind and extent of color weakness. When an image is displayed based on the image signals to which an inverse matrix of the daltonization matrix is multiplied, the person with color vision impairment can normally perceive the colors like a normally sighted person.

The first converter 222 performs color weakness-compensating conversion on the received image signals. The following equation shows the relationship between a red signal Ri, a green signal Gi, and a blue signal Bi included in an image signal supplied to the first converter 222 and a converted red signal Ro, a converted green signal Go, and a converted blue signal Bo included in a converted image signal outputted from the first converter 222.

$$\begin{bmatrix} Ro \\ Go \\ Bo \end{bmatrix} = \frac{X}{255}[\Gamma^{-1}]\begin{bmatrix} Ri \\ Gi \\ Bi \end{bmatrix} \quad \text{Equation 2}$$

Herein, Ri, Gi and Bi refer to the red signal, the green signal, and the blue signal included in the image signal, Ro, Go and Bo refer to the converted red signal, the converted green signal, and the converted blue signal, X refers to a gray-compensating value, and $\Gamma^{-1}$ refers to the inverse matrix of the daltonization matrix.

In more detail, X is a value for compensating an increase of the gray caused by the inverse matrix of the daltonization matrix. X is determined based on the maximum luminance of the display panel 100, and it may be in a range of 1 to 255.

The first converter 222 receives the first image signals RGBC and outputs the converted first image signals RGBCt. The following equation shows the relationship between the first red signal RC, the first green signal GC, and the first blue signal BC supplied to the first converter 222 and the converted first red signal RCt, the converted first green signal GCt, and the converted first blue signal BCt outputted from the first converter 222.

$$\begin{bmatrix} RCt \\ GCt \\ BCt \end{bmatrix} = \frac{X}{255}[\Gamma^{-1}]\begin{bmatrix} RC \\ GC \\ BC \end{bmatrix} \quad \text{Equation 3}$$

The second converter 223 converts the second image signals RGBN to RGBNt. Converted second image signals RGBNt include converted second red signal RNt, converted second green signal GNt, and converted second blue signal BNt. In the second area corresponding to the second converter 223, these conversions may be performed to conform luminance of the second area with that of the first area.

When the conversions for the second area are performed, the following equation shows the relationship between the second red signal RN, the second green signal GN, and the second blue signal BN supplied to the second converter 223 and the converted second red signal RNt, the converted second green signal GNt, and the converted second blue signal BNt outputted from the second converter 223.

$$\begin{bmatrix} RNt \\ GNt \\ BNt \end{bmatrix} = \frac{X}{255}\begin{bmatrix} RN \\ GN \\ BN \end{bmatrix} \quad \text{Equation 4}$$

When the conversions for the second area are not performed, the second converter 223 may be omitted in the timing controller 220. In this case, the second image signals RGBN may be directly transmitted to the signal transmitter 224.

The signal transmitter 224 generates converted image signals RGBt by combining the first image signals RGBCt and the converted second image signals RGBNt. The converted image signals RGBt include converted red signals Rt, converted green signals Gt, and converted blue signals Bt. The signal transmitter 224 supplies the converted image signals RGBt to the data driver 230.

Figure 3:
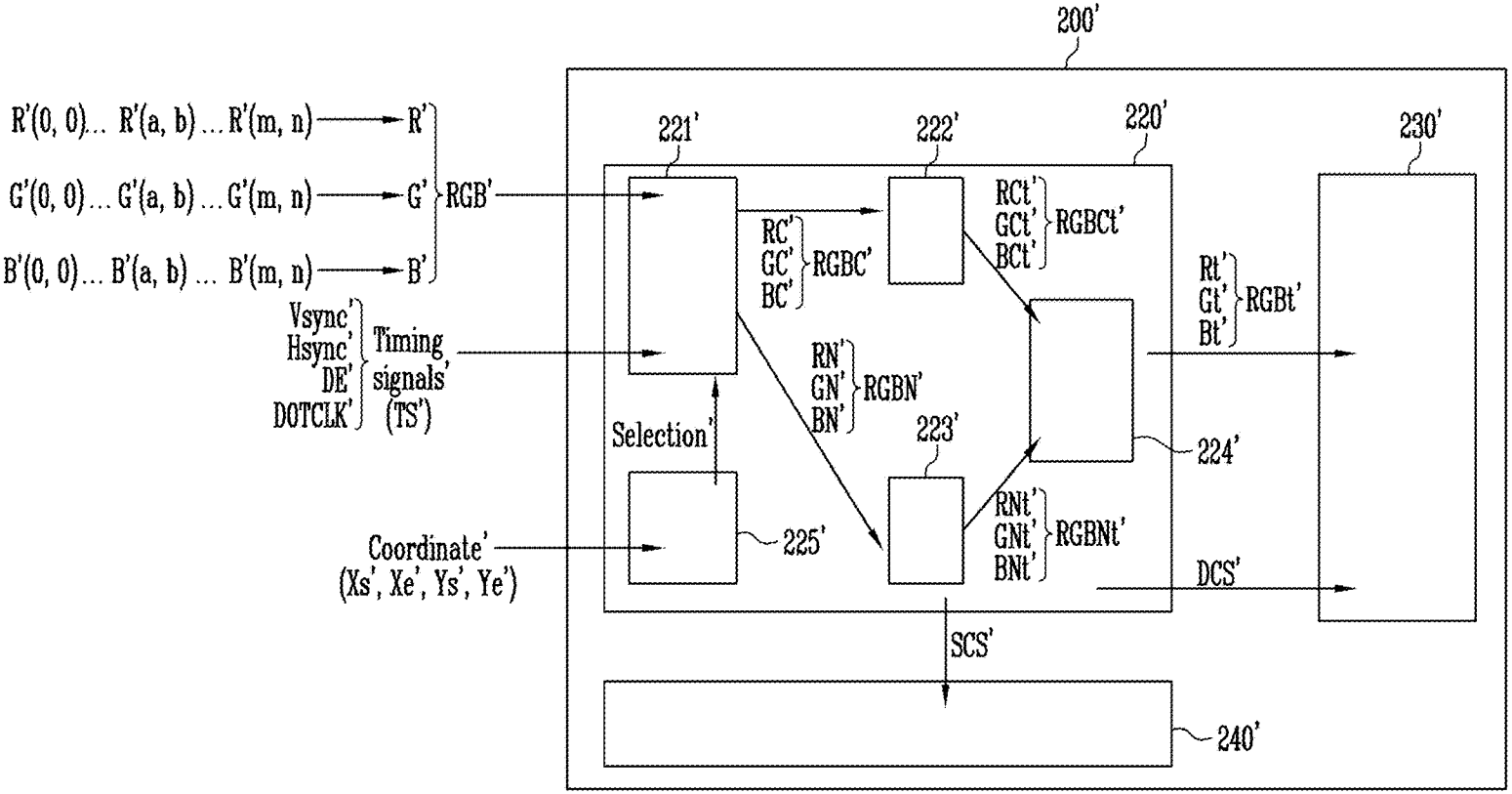
FIG. 3 is a block diagram illustrating another exemplary embodiment of the timing controller in the display device of FIG. 1.

FIG. 3 is a block diagram illustrating another exemplary embodiment of the timing controller in the display device of FIG. 1. A timing controller 220' includes a signal receiver 221', a first converter 222', a second converter 223', a signal transmitter 224', and a selection signal generator 225'.

The signal receiver 221' receives image signals RGB' and timing signals TS' from the outside. In addition, the signal receiver 221' receives selection signals Selection' from the selection signal generator 225'. The image signals RGB' include red signals R', green signals G', and blue signals B'. The timing signals TS' include vertical synchronization signals Vsync', horizontal synchronization signals Hsync', data enable signals DE', and dot clocks DOTCLK'.

The red signals R', the green signals G', the blue signals B', the vertical synchronization signals Vsync', the horizontal synchronization signals Hsync', the data enable signals DE', and the dot clocks DOTCLK' are respectively the same as the red signals R, the green signals G, the blue signals B, the vertical synchronization signals Vsync, the horizontal synchronization signals Hsync, the data enable signals DE, and the dot clocks DOTCLK of the previous exemplary embodiment. Accordingly, a detailed description thereof may not be provided. First image signals RGBC' corresponding to the selection signals Selection' with a first logic value are supplied to the first converter 222' from the signal receiver 221'. Second image signals RGBN' corresponding to the selection signals Selection' with a second logic value are supplied to the second converter 223' from the signal receiver 221'. The first image signals RGBC' include first red signals RC', first green signals GC', and first blue signals BC', whereas the second image signals RGBN' include second red signals RN', second green signals GN', and second blue signals BN'. The first red signals RC', the first green signals GC', the first blue signals BC', the second red signals RN', the second green signals GN', and the second blue signals BN' are respectively same as the first red signals RC, the first green signals GC, the first blue signals BC, the second red signals RN, the second green signals GN, and the second blue signals BN of the previous exemplary embodiment. Accordingly, a detailed description thereof may not be provided. The second converter 223' may be omitted. In this case, the second image signals RGBN' are directly supplied to the signal transmitter 224'.

The first converter 222' converts the first image signals RGBC' to RGBCt'. The converted first image signals RGBCt' include the converted red signals RCt', the converted green signals GCt', and the converted blue signals BCt'. A method in which the first converter 222' converts the first image signals RGBC' to RGBCt' is same as that of the previous exemplary embodiment. Accordingly, a detailed description thereof may not be provided.

The second converter 223' converts the second image signals RGBN' to RGBNt'. The converted second image signals RGBNt' include the converted second red signals RNt', the converted second green signals GNt', and the converted second blue signals BNt'. A method in which the second converter 223' converts the second image signals RGBN' to RGBNt' is same as that of the previous exemplary embodiment. Accordingly, a detailed description thereof may not be provided.

The signal transmitter 224' generates converted image signals RGBt' by combining the first image signals RGBCt' and the converted second image signals RGBNt'. The converted image signals RGBt' include converted red signals Rt', converted green signals Gt', and converted blue signals Bt'. The signal transmitter 224' supplies the converted image signals RGBt' to the data driver 230'.

The selection signal generator 225' receives coordinate information Coordinate' from the outside. The coordinate information Coordinate' includes a first direction start coordinate Xs', a first direction end coordinate Xe', a second direction start coordinate Ys', and a second direction end coordinate Ye'. The selection signal generator 225' generates the selection signals Selection' on the basis of the coordinate information and transmits them to the signal receiver 221'.

The selection signals Selections' (corresponding to the pixels P whose first direction coordinates are between the first direction start coordinate Xs' and the first direction end coordinate Xe' and whose second direction coordinates are between the second direction start coordinate Ys' and the second direction end coordinate Ye') have the first logic value. The selection signals Selections' (corresponding to the pixels P whose first direction coordinates are beyond the range of the first direction start coordinate Xs' to the first direction end coordinate Xe' or whose second direction coordinates are beyond the range of second direction start coordinate Ys' to the second direction end coordinate Ye') have the second logic value. For example, in the pixel (a, b), if index b is between the first direction start coordinate Xs' and the first direction end coordinate Xe' and index a is between the second direction start coordinate Ys' and the second direction end coordinate Ye', the selection signal Selection' corresponding to the pixel (a, b) has the first logic value. However, if index b is beyond the range of the first direction start coordinate Xs' to the first direction end coordinate Xe', or index a is beyond the range of the second direction start coordinate Ys' to the second direction end coordinate Ye', the selection signal Selection' corresponding to the pixel (a, b) has the second logic value. This is only one of possible embodiments, so various suitable variations may be possible. For example, in the case in which index b is between the first direction start coordinate Xs' and the first direction end coordinate Xe' and index a is beyond the range of the second direction start coordinate Ys' to the second direction end coordinate Ye', the selection signal Selection' may have the second logic value.

In the previously described embodiment with reference to FIG. 2, the signal receiver 221 receives the selection signals Selection corresponding to the image signals RGB. However, in this embodiment with reference to FIG. 3, the selection signal generator 225' generates the selection signals Selection' corresponding to the image signals RGB' on the basis of the coordinate information Coordinate'.

Figure 4:
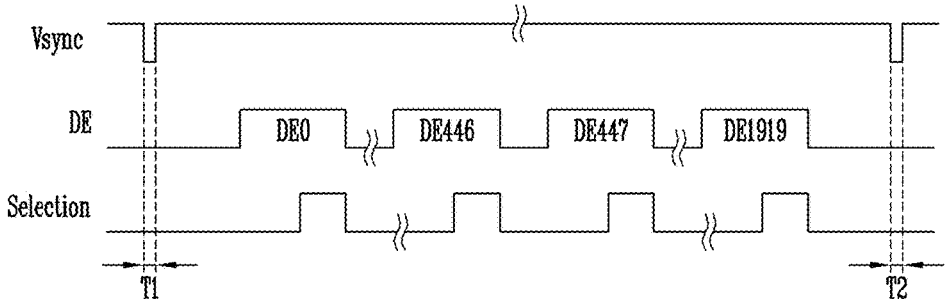
FIG. 4 is a waveform diagram illustrating some of the timing signals and selection signals supplied to a signal receiver of FIG. 1.

FIG. 4 is a waveform diagram illustrating some of the timing signals and selection signals supplied to the signal receiver of FIG. 1. The vertical synchronization signals Vsync, the data enable signals DE, and the selection signals Selection will be described in more detail below with reference to FIG. 4. In the description of FIG. 4, the first direction coordinates of the pixels P included in the first area are always smaller than those of the pixels P included in the second area. For example, the first area may be a left-positioned area from a reference line extending in the second direction in the display panel 100, and the second area may be a right-positioned area from the reference line.

The vertical synchronization signals Vsync have a low level during the first period T1.

After the first period T1, the vertical synchronization signals Vsync change to high level, and the 0th data enable signal DE0 to the 1919th data enable signal DE1919 are sequentially supplied to the signal receiver 221. The number of the data enable signals DE is 1920, but the present disclosure is not limited thereto.

The second period T2 starts after the 1919th data enable signal DE1919 is supplied. The vertical synchronization signals Vsync have a low level during the second period T2.

The selection signals Selection have a high level during a partial period of a supply period of the corresponding data enable signal DE, having low level during the other period. For example, the selection signals Selection of low level are supplied from when the 0th data enable signal DE0 starts to be supplied to a preset time point, whereas the selection signals Selection of high level are supplied after the preset time point until a supply of the 0th data enable signal DE0 stops. The levels of the selection signals Selection will be described later in further detail with reference to FIG. 5.

Figure 5:
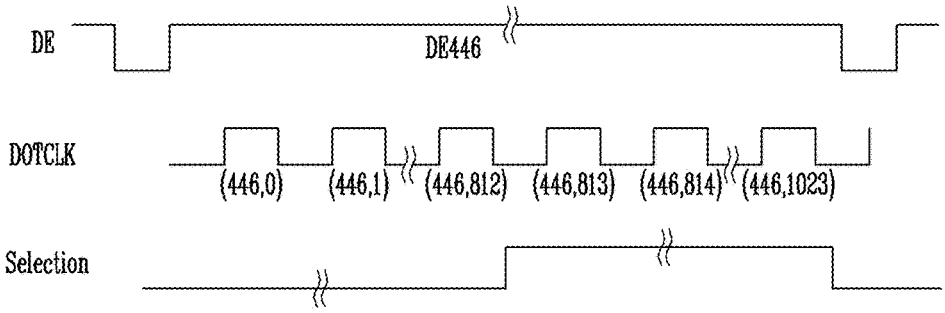
FIG. 5 is a waveform diagram illustrating some of the timing signals supplied to the signal receiver of FIG. 1, signals generated based on the timing signals, and the selection signals.

FIG. 5 is a waveform diagram illustrating some of the timing signals supplied to the signal receiver of FIG. 1, signals generated based on the timing signals, and the selection signals. These signals are described with reference to FIG. 1 and FIGS. 4-5.

While the 446th data enable signal DE446 of high level is supplied, the dot clocks DOTCLK are supplied. In detail, 1024 dot clocks from DOTCLK (446, 0) to DOTCLK(446, 1023) are supplied. It may be assumed that the dot clock DOTCLK(a, b) corresponds to the pixel P(a, b).

The selection signals Selection corresponding to the dot clocks from DOTCLK(446, 0) to DOTCLK(446, 812) have a low level, whereas the selection signals Selection corresponding to the dot clocks from DOTCLK(446, 813) to DOTCLK(446, 1023) have a high level. That is, the pixel P(446, 0) to the pixel P(446, 812) are included in the first area, whereas the pixel P(446, 813) to the pixel P(446, 1023) are included in the second area.

Figure 6:
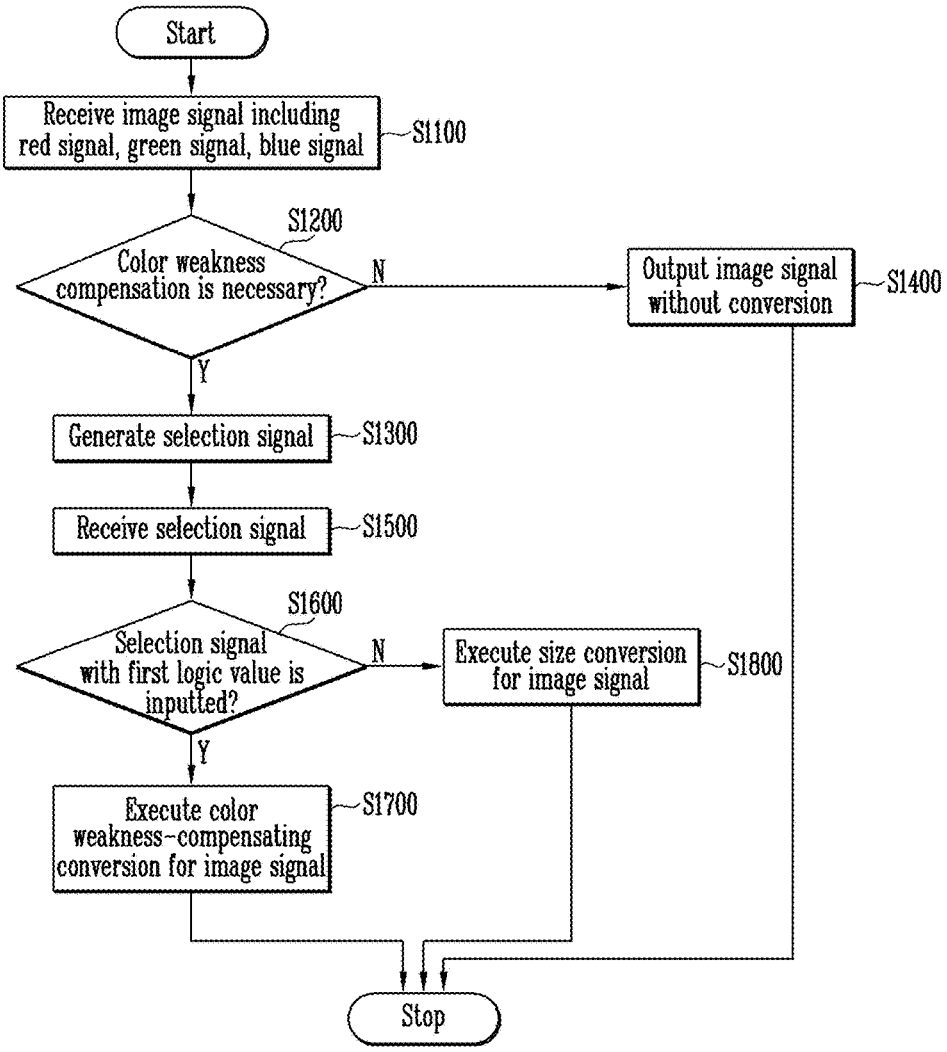
FIG. 6 is a flow diagram illustrating a driving method of the display device according to an embodiment of the present disclosure.

FIG. 6 is a flow diagram illustrating a driving method of the display device according to an embodiment of the present disclosure. The driving method of the display device according to the embodiment of the present disclosure will be described below with reference to FIG. 1 to FIG. 6. In FIG. 6, only one pixel P(a, b) is described for ease of description.

At act S1100, the timing controller 220 receives the image signal. The image signal is one of the image signals RGB and it may be represented by RGB(a, b). As described above, the image signals RGB(a, b) include the red signal R(a, b), the green signal G(a, b), and the blue signal B(a, b).

At act S1200, it is determined whether or not to perform color weakness compensation. If the color weakness compensation is necessary, an act S1300 is performed as the next act, and if not, an act S1400 is performed.

At act S1300, the selection signal generator 225' generates the selection signal Selection on the basis of coordinate information Coordinate' supplied from the outside. The act S1300 may be omitted in the case in which the selection signal Selection is supplied from the outside.

The following acts will be described in more detail with reference to FIG. 7.

At act S1400, the image signal RGB(a, b) is supplied to the data driver 230 as is, because the color weakness compensation is unnecessary.

At act S1500, the timing controller 220 receives the selection signals Selection from the outside. The act S1500 may be omitted when the selection signal generator 225' generates the selection signals Selection' on the basis of the coordinate information Coordinate'.

At act S1600, it is determined whether the logic value of the selection signal Selection(a, b) corresponding to the image signal RGB(a, b) is the first logic value, or not. If yes, an act S1700 is executed as the next act because the image signal RGB(a, b) is one of the first image signals RGBC, and if not, an act S1800 is executed because the image signal RGB(a, b) is one of the second image signals RGBN.

At act S1700, color weakness-compensating conversion is performed on the image signal RGB(a, b). The resulted image signal from the color weakness-compensating conversion is one of the converted first image signals RGBCt. The relationship between the image signal and the converted image signal has been already described using the equation 2.

At act S1800, the size of the image signal RGB(a, b) is converted. The image signal whose size is converted is one of the converted second image signals RGBNt. The relationship between the image signal and the size-converted image signal has been already described using the equation 4. In this act, the relative ratio of the red, green, and blue signals in the image signal do not change and only the sizes thereof decrease by a preset ratio. The act S1800 may be omitted. In this case, the image signal RGB(a, b) is directly supplied to the signal transmitter 224.

Figure 7:
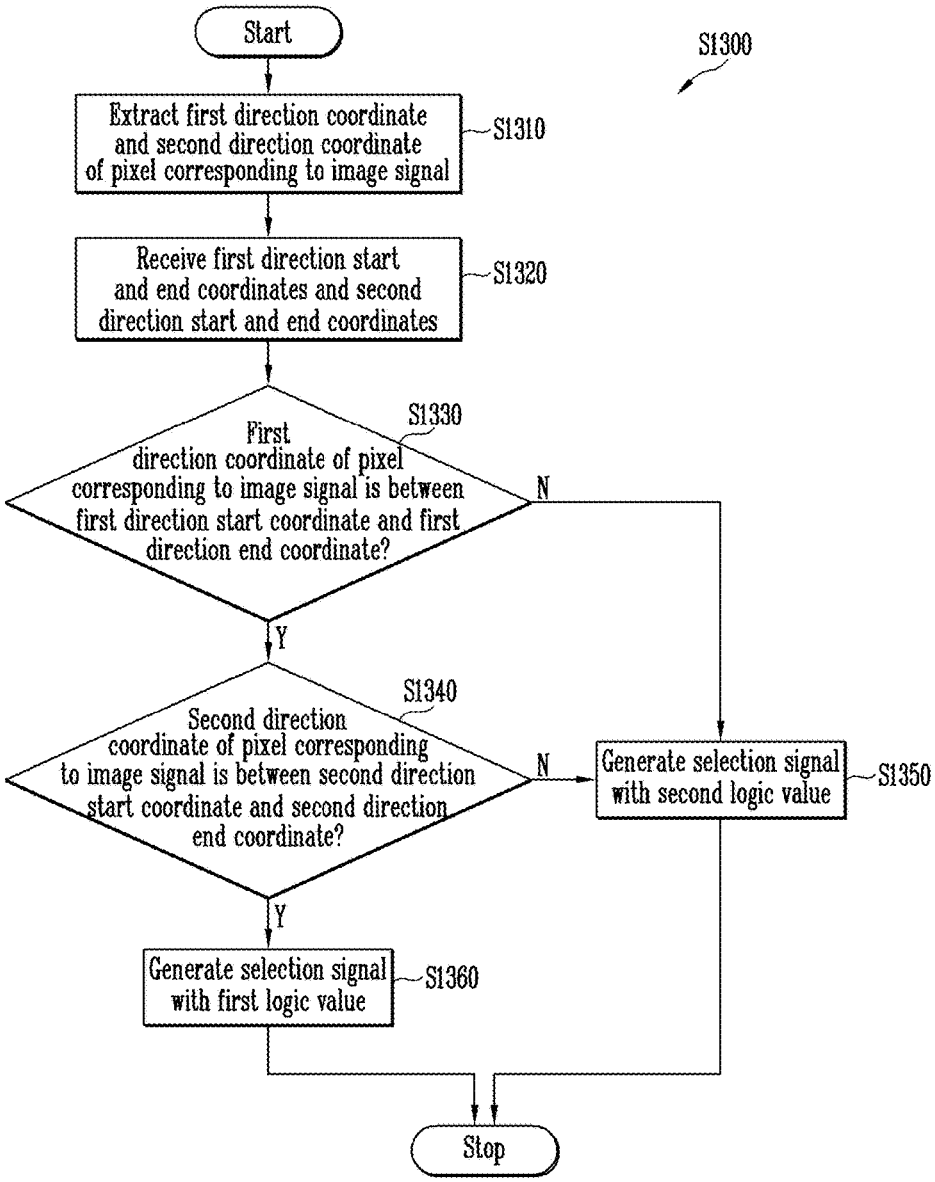
FIG. 7 is a flow diagram illustrating a procedure of generating the selection signal in the driving method shown in FIG. 6.

FIG. 7 is a flow diagram illustrating a procedure of generating the selection signal in the driving method shown in FIG. 6. The procedure of generating the selection signal will be described with reference to FIG. 1 to FIG. 7.

At act S1310, the first and second direction coordinates of the pixel P corresponding to the image signal RGB(a, b) are extracted. The extracted first direction coordinate is "a" and the extracted second direction coordinate is "b".

At act S1320, the selection signal generator 225' receives coordinates information Coordinate' including the first direction start coordinate Xs', the first direction end coordinate Xe', the second direction start coordinate Ys', and the second direction end coordinate Ye'. In FIG. 7, the act S1320 is executed after the act S1310, but the sequence thereof may be reversed.

At act S1330, a comparison of the first direction coordinate "b" of the pixel P(a, b), the first direction start coordinate Xs', and the first direction end coordinate Xe' is executed. That is, it is determined whether or not the first direction coordinate "b" is between the first direction start coordinate Xs' and the first direction end coordinate Xe'. If it is between the stated range, an act S1340 is executed as the next act, and if not, an act S1350 is executed.

At act S1340, a comparison of the second direction coordinate "a" of the pixel P(a, b), the second direction start coordinate Ys', and the second direction end coordinate Ye' is executed. That is, it is determined whether or not the second direction coordinate "a" is between the second direction start coordinate Ys' and the second direction end coordinate Ye'. If it is between the stated range, an act S1360 is executed as the next act, and if not, an act S1350 is executed.

At act S1350, the selection signal Selection(a, b) with the second logic value is generated because the pixel P(a, b) is not included in the first area.

At act S1360, the selection signal Selection(a, b) with the first logic value is generated because the pixel P(a, b) is included in the first area.

Figure 8:
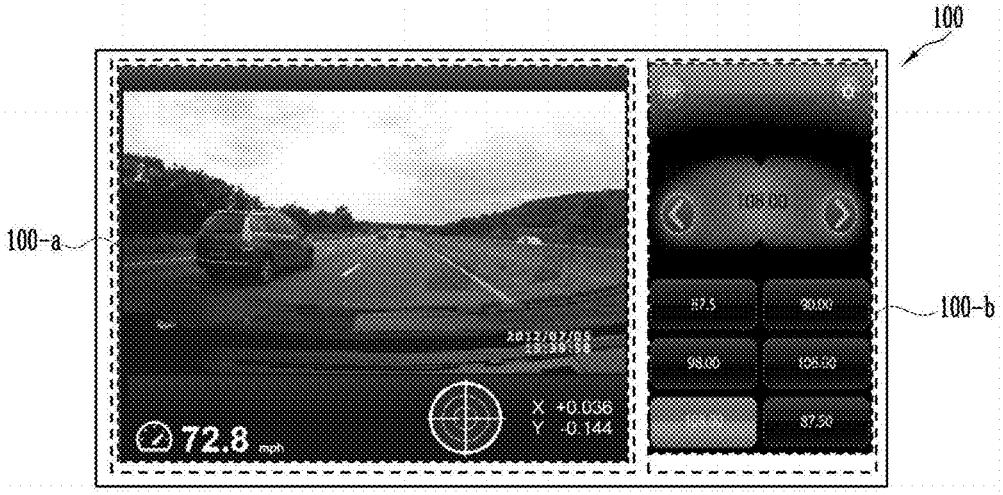
FIG. 8 is a view illustrating an exemplary embodiment of an image displayed by a display panel in the display device shown in FIG. 1.

FIG. 8 is a view illustrating an exemplary embodiment of an image displayed by the display panel in the display device shown in FIG. 1. In the exemplary embodiment shown in FIG. 8, it may be assumed that the display panel 100 is provided in a transportation vehicle (e.g., a car or the like). Referring to FIG. 8, the display panel 100 includes a first area 100-*a* and a second area 100-*b*. In the first area 100-*a* for a driver with color vision impairment, an image photographed by a camera is displayed after color weakness-compensating conversion, whereas in the second area 100-*b* for a normally sighted person sitting on a passenger seat, an interface screen is displayed after size conversion. In this way, because the color weakness-compensating conversion is executed for only a partial screen of the display panel 100, the image display for the driver with color vision impairment and the image display for the normally sighted person sitting on the passenger seat can be implemented at the same time.

Figure 9:
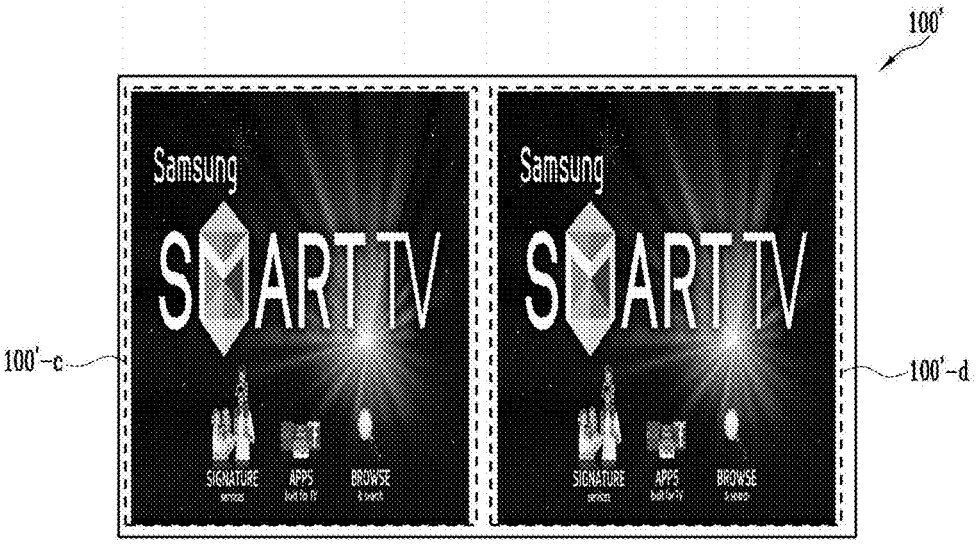
FIG. 9 is a view illustrating another exemplary embodiment of an image displayed by the display panel in the display device shown in FIG. 1.

FIG. 9 is a view illustrating another exemplary embodiment of an image displayed by the display panel in the display device shown in FIG. 1. In the exemplary embodiment shown in FIG. 9, it may be assumed that the display panel 100' is a television installed in a common home. Referring to FIG. 9, the display panel 100' includes a first area 100'-*c* and a second area 100'-*d*. In the first area 100'-*c* for persons with color vision impairment, a first image supplied from the outside is displayed after color weakness-compensating conversion, whereas in the second area 100'-*d* for normally sighted persons, the first image supplied is displayed after size conversion. In this way, because the color weakness-compensating conversion is executed for only a partial screen of the display panel 100', the image display for the persons with color vision impairment and the image display for the normally sighted persons can be implemented at the same time.

Example embodiments have been disclosed herein and although specific terms are employed, they are used and are to be interpreted in a generic and descriptive sense and not for purpose of limitation. In some instances, as would be apparent to one of ordinary skill in the art as of the filing of the present application, features, characteristics and/or elements described in connection with a particular embodiment may be used singly or in combination with features, characteristics and/or elements described in connection with other embodiments unless otherwise specifically indicated. Accordingly, it will be understood by those of skill in the art that various changes in form and details may be made without departing from the spirit and scope of the present invention as set forth in the following claims, and equivalents thereof.

It will be understood that, although the terms "first", "second", "third", etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section discussed below could be termed a second element, component, region, layer or section, without departing from the spirit and scope of the inventive concept.

The terminology used herein is for the purpose of describing particular embodiments and is not intended to be limiting of the inventive concept. As used herein, the singular forms "a" and "an" are intended to include the plural forms as well, unless the context clearly indicates otherwise. It will be further understood that the terms "include," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list. Further, the use of "may" when describing embodiments of the inventive concept refers to "one or more embodiments of the inventive concept." Also, the term "exemplary" is intended to refer to an example or illustration.

It will be understood that when an element or layer is referred to as being "on", "connected to", "coupled to", or "adjacent to" another element or layer, it can be directly on, connected to, coupled to, or adjacent to the other element or layer, or one or more intervening elements or layers may be present. When an element or layer is referred to as being "directly on," "directly connected to", "directly coupled to", or "immediately adjacent to" another element or layer, there are no intervening elements or layers present.

As used herein, the terms "use," "using," and "used" may be considered synonymous with the terms "utilize," "utilizing," and "utilized," respectively.

The display device and/or any other relevant devices or components according to embodiments of the present invention described herein may be implemented utilizing any suitable hardware, firmware (e.g. an application-specific integrated circuit), software, or a suitable combination of software, firmware, and hardware. For example, the various components of the display device may be formed on one integrated circuit (IC) chip or on separate IC chips. Further, the various components of the display device may be implemented on a flexible printed circuit film, a tape carrier package (TCP), a printed circuit board (PCB), or formed on a same substrate. Further, the various components of the display device may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the scope of the exemplary embodiments of the present invention.

What is claimed is:

1. A display device comprising:

a display panel comprising pixels; and a display panel driver configured to drive the display panel, wherein the display panel driver comprises a timing controller configured to receive image signals and timing signals from the outside, to convert at least some of the image signals, and to output the converted image signals, each of the image signals corresponding to a respective one of the pixels, wherein the image signals comprise first image signals corresponding to a first area in the display panel, wherein each of image signals corresponds to each of the pixels and comprises a red signal, a green signal, and a blue signal, wherein the timing controller comprises a signal receiver configured to receive the image signals and the timing signals, and a first converter configured to receive the first image signals from the signal receiver, to perform color weakness-compensating conversion on the first image signals, and to output the converted first image signals, wherein the timing controller further comprises a selection signal generator configured to generate selection signals, and the selection signals corresponding to the first area defined by coordinate information received from outside have a first logic value, wherein the selection signal generator is further configured to receive the coordinate information comprising a first direction start coordinate, a first direction end coordinate, a second direction start coordinate, and a second direction end coordinate, and wherein each one of the first and second start coordinates and the first and second end coordinates corresponds to a respective one of the pixels.

2. The display device of claim 1, wherein the red signal, the green signal, and the blue signal of one of the first image signals change to a converted red signal, a converted green signal, and a converted blue signal of one of the converted first image signals according to the following equation:

$$\begin{bmatrix} RCt \\ GCt \\ BCt \end{bmatrix} = \frac{X}{255}[\Gamma^{-1}]\begin{bmatrix} RC \\ GC \\ BC \end{bmatrix}$$

where RC, GC and BC refer to the red signal, the green signal, and the blue signal, respectively, of one of the first image signals, RCt, GCt and BCt refer to the converted red signal, the converted green signal, and the converted blue signal, respectively, of one of the converted first image signals, X refers to a gray-compensating value, and $\Gamma^{-1}$ refers to an inverse matrix of a daltonization matrix.

3. The display device of claim 1, wherein the image signals further comprise second image signals corresponding to a second area not overlapping with the first area in the display panel, wherein the timing controller further comprises a second converter configured to receive the second image signals, to perform size conversion on the second image signals to generate converted second image signals, and to output the converted second image signals.

4. The display device of claim 3, wherein the red signal, the green signal, and the blue signal of one of the second image signals change to a converted red signal, a converted green signal, and a converted blue signal of one of the converted second image signals according to the following equation:

$$\begin{bmatrix} RNt \\ GNt \\ BNt \end{bmatrix} = \frac{X}{255}\begin{bmatrix} RN \\ GN \\ BN \end{bmatrix}$$

where RN, GN and BN refer to the red signal, the green signal, and the blue signal, respectively, of one of the second image signals, RNt, GNt and BNt refer to the converted red signal, the converted green signal, and the converted blue signal, respectively, of one of the converted second image signals, and X refers to a gray-compensating value.

5. The display device of claim 1, wherein the signal receiver is further configured to receive the selection signals, and each of the selection signals corresponds to a respective one of the pixels.

6. The display device of claim 5, wherein the image signals further comprise second image signals corresponding to a second area not overlapping with the first area in the display panel, wherein the timing controller further comprises a second converter configured to receive second image signals and to output converted second image signals, and wherein the selection signals corresponding to the second area have a second logic value.

7. The display device of claim 1, wherein the selection signals corresponding to ones of the pixels having first direction coordinates between the first direction start coordinate and the first direction end coordinate and having second direction coordinates between the second direction start coordinate and the second direction end coordinate have the first logic value, and the selection signals corresponding to other ones of the pixels having first direction coordinates beyond a range of the first direction start coordinate to the first direction end coordinate or having second direction coordinates beyond a range of second direction start coordinate to the second direction end coordinate have a second logic value.

8. The display device of claim 7, wherein the signal receiver is configured to receive the selection signals, to output only ones of the image signals corresponding to the selection signals with the first logic value to the first converter, and not to output other ones of the image signals corresponding to the selection signals with the second logic value.

9. A driving method of a display device, the driving method comprising:

receiving an image signal comprising a red signal, a green signal, and a blue signal and corresponding to a pixel;

receiving a selection signal;

performing color weakness-compensating conversion on the image signal; and generating the selection signal, wherein the color weakness-compensating conversion is performed only when the selection signal has a first logic value, wherein selection signals corresponding to a first area of a display panel defined by coordinate information received from outside have the first logic value, wherein the generating of the selection signal comprises:

receiving information about a first direction start coordinate, a first direction end coordinate, a second direction start coordinate, and a second direction end coordinate, and wherein each one of the first and second start coordinates and the first and second end coordinates corresponds to a respective one of the pixels.

10. The driving method of claim 9, wherein the performing color weakness-compensating conversion comprises converting the image signal according to the following equation:

$$\begin{bmatrix} Ro \\ Go \\ Bo \end{bmatrix} = \frac{X}{255}[\Gamma^{-1}]\begin{bmatrix} Ri \\ Gi \\ Bi \end{bmatrix}$$

where Ri, Gi and Bi refer to the red signal, the green signal, and the blue signal, respectively, Ro, Go, and Bo refer to a converted red signal, a converted green signal, and a converted blue signal, respectively, after the color weakness-compensating conversion, X refers to a gray-compensating value, and $\Gamma^{-1}$ refers to an inverse matrix of a daltonization matrix.

11. The driving method of claim 9, further comprising converting a size of the image signal, wherein the converting of the size of the image signal is performed only when the selection signal has a second logic value different with the first logic value.

12. The driving method of claim 11, wherein the converting of the size of the image signal generates a size-converted image signal according to the following equation:

$$\begin{bmatrix} Ro \\ Go \\ Bo \end{bmatrix} = \frac{X}{255}\begin{bmatrix} Ri \\ Gi \\ Bi \end{bmatrix}$$

where Ri, Gi and Bi refer to the red signal, the green signal, and the blue signal, respectively, Ro, Go and Bo refer to a size-converted red signal, a size-converted green signal, and a size-converted blue signal, respectively, and X refers to a gray-compensating value.

13. The driving method of claim 9, wherein the generating of the selection signal is performed prior to the receiving of the selection signal.

14. The driving method of claim 13, wherein the generating of the selection signal further comprises:

extracting a first coordinate and a second coordinate of the pixel corresponding to the image signal; and generating the selection signal with the first logic value, wherein the generating of the selection signal with the first logic value is performed only when the first coordinate of the pixel corresponding to the image signal is between the first direction start coordinate and the first direction end coordinate and the second coordinate of the pixel corresponding to the image signal is between the second direction start coordinate and the second direction end coordinate.

* * * * *